US007654512B2

(12) United States Patent
Kawata et al.

(10) Patent No.: US 7,654,512 B2
(45) Date of Patent: Feb. 2, 2010

(54) IMAGE FORMING SYSTEM, IMAGE FORMING METHOD AND IMAGE FORMING APPARATUS

(75) Inventors: Wataru Kawata, Kashiwa (JP); Akihiro Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 891 days.

(21) Appl. No.: 11/219,727

(22) Filed: Sep. 7, 2005

(65) Prior Publication Data

US 2006/0055766 A1 Mar. 16, 2006

(30) Foreign Application Priority Data

Sep. 16, 2004 (JP) ..... 2004-269972
Jun. 15, 2005 (JP) ..... 2005-175145

(51) Int. Cl.
*B65H 37/04* (2006.01)

(52) U.S. Cl. ..... 270/58.28; 270/1.01; 270/12; 270/15; 270/17; 270/58.08; 270/58.07; 270/58.11; 270/58.13

(58) Field of Classification Search ..... 270/1.01, 270/12, 15, 17, 58.07, 58.08, 58.09, 58.11, 270/58.13, 58.23, 58.28, 58.34
See application file for complete search history.

(56) References Cited

U.S. PATENT DOCUMENTS

| | | | | |
|---|---|---|---|---|
| 4,591,884 | A | 5/1986 | Miyamoto et al. | 346/153.1 |
| 5,008,709 | A | 4/1991 | Shinada et al. | 355/309 |
| 5,731,879 | A | 3/1998 | Maniwa et al. | |
| 6,912,057 | B1 | 6/2005 | Idehara | 358/1.1 |

FOREIGN PATENT DOCUMENTS

| | | | |
|---|---|---|---|
| JP | 59-222860 | | 12/1984 |
| JP | 2-23176 | | 1/1990 |
| JP | 5-19556 | | 1/1993 |
| JP | 8-278728 | A | 10/1996 |
| JP | 10-35059 | A | 2/1998 |
| JP | 11-119500 | A | 4/1999 |
| JP | 11-259254 | A | 9/1999 |
| JP | 2000-267376 | | 9/2000 |

(Continued)

OTHER PUBLICATIONS

Japanese Notification of Reason for Refusal dated Jul. 7, 2008 in Japanese Application No. 2004-269972, and English-language translation thereof.

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

Image forming system including at least one image forming apparatus for forming images on sheets on the basis of image data. At least one temporary containing apparatus is disposed downstream of the image forming apparatus for temporarily containing therein the sheets on which the images have been formed. A separating and conveying apparatus separates and conveys the sheets contained in the temporary containing apparatus one by one. A sheet post-processing apparatus conveys the sheets conveyed by the separating and conveying apparatus and the sheets on which the images have been formed by the image forming apparatus and which bypass the temporary containing apparatus in an arbitrary order, in order to effect a set post-process on the conveyed sheets.

12 Claims, 6 Drawing Sheets

FOREIGN PATENT DOCUMENTS

| | | | |
|---|---|---|---|
| JP | 2000-338737 | A | 12/2000 |
| JP | 2002-103715 | A | 4/2002 |
| JP | 2002-157102 | A | 5/2002 |
| JP | 2003-251459 | | 8/2003 |
| JP | 2004-51268 | A | 2/2004 |
| JP | 2004-58354 | A | 2/2004 |
| JP | 2004-93984 | A | 3/2004 |

IMAGE FORMING SYSTEM, IMAGE FORMING METHOD AND IMAGE FORMING APPARATUS

BACKGROUND OF THE INVENTION

1. Field of the Invention

This invention relates to an image forming system provided with at least one image forming apparatus, an image forming method therefor and an image forming apparatus.

2. Related Background Art

Generally, much waste occurs when outputting a document including different kinds of data patterns such as color data, text data or image data by an image forming apparatus. For example, in a color image forming apparatus, the printing speed is generally low, and when a single black image is to be outputted, it is better from the viewpoint of efficiency to use a monochrome image forming apparatus than to use a color image forming apparatus.

Therefore, as shown, for example, in Japanese Examined Patent Publication No. H04-68153, in order to be capable of coping with various data forms, there has been proposed a technique of paging and sorting the output documents of a color image forming apparatus and the output documents of a monochromatic image forming apparatus to thereby obtain a form of document.

In recent years, however, due to improvements in and advance of software and hardware, the image editing capability on a computer has become diverse and along therewith, image forming patterns are becoming diversified and advanced highly. As a result, as a document, one having an image comprising a different pattern on each page is increasing.

Also, a document having pages of different sizes such as A3 size and A4 size mixedly present therein, like large-sized paper Z-folded so as to match with small-sized paper is increasing.

In such a background, when originals or document data are to be copied or printed from different print patterns or different sizes of respective pages in a document, it is strongly desired to efficiently effect copying or printing in the order of pages.

SUMMARY OF THE INVENTION

It is an object of the present invention to provide an image forming system, an image forming method and an image forming apparatus which, when executing a job including the process of temporarily storing an image-formed sheet, can stably feed the temporarily stored image-formed sheet without injuring the sheet.

In order to achieve the above object, the present invention provides an image forming system comprising:

at least one image forming apparatus for forming images on sheets on the basis of image data;

at least one temporary containing apparatus disposed downstream of the image forming apparatus for temporarily containing therein the sheets on which the images have been formed;

a separating and conveying apparatus for separating and conveying the sheets contained in the temporary containing apparatus one by one; and a sheet post-processing apparatus for conveying the sheets conveyed by the separating and conveying apparatus and the sheets on which the images have been formed by the image forming apparatus and which have bypassed the temporary containing apparatus in an arbitrary order, and effecting a set post-process on the conveyed sheets;

wherein the aforementioned at least one image forming apparatus makes the order of outputting of the image data to the sheets contained in the temporary containing apparatus and the order of outputting of the image data to the sheets which bypass the temporary containing apparatus reverse to each other.

Also, in order to achieve the above object, the present invention provides an image forming method for an image forming system provided with at least one image forming apparatus for forming images on sheets on the basis of image data, at least one the image forming apparatus for temporarily storing therein the sheets on which the images have been formed, a separating and conveying apparatus for separating and conveying the sheets contained in the temporary containing apparatus one by one, and a sheet post-processing apparatus for conveying the sheets conveyed by the separating and conveying apparatus and the sheets on which the images have been formed by the image forming apparatus and which have bypassed the temporary containing apparatus in an arbitrary order, and effecting a set post-process on the conveyed sheets, wherein the aforementioned at least one image forming apparatus makes the order of outputting of the image data to the sheets contained in the temporary containing apparatus and the order of outputting of the image data to the sheets which bypass the temporary containing apparatus reverse to each other.

Also, in order to achieve the above object, the present invention provides an image forming apparatus connected to a temporary containing apparatus in which sheets are temporarily contained, comprising:

an image forming unit for forming images on sheets on the basis of image data; and a discriminating device for discriminating whether the sheets on which the images have been formed by the image forming unit should be contained in the temporary containing apparatus or not;

wherein the order of outputting of the image data to the sheets discriminated by the discriminating device that they should be contained in the temporary containing apparatus and the order of outputting of the image data to the sheets discriminated by the discriminating device that they should not be contained in the temporary containing apparatus are made reverse to each other.

Other objects and features of the present invention will become apparent from the following detailed description and the accompanying drawings.

DESCRIPTION OF THE PREFERRED EMBODIMENTS

Some embodiments of the present invention will hereinafter be described with reference to the drawings.

First Embodiment

Figure 1:
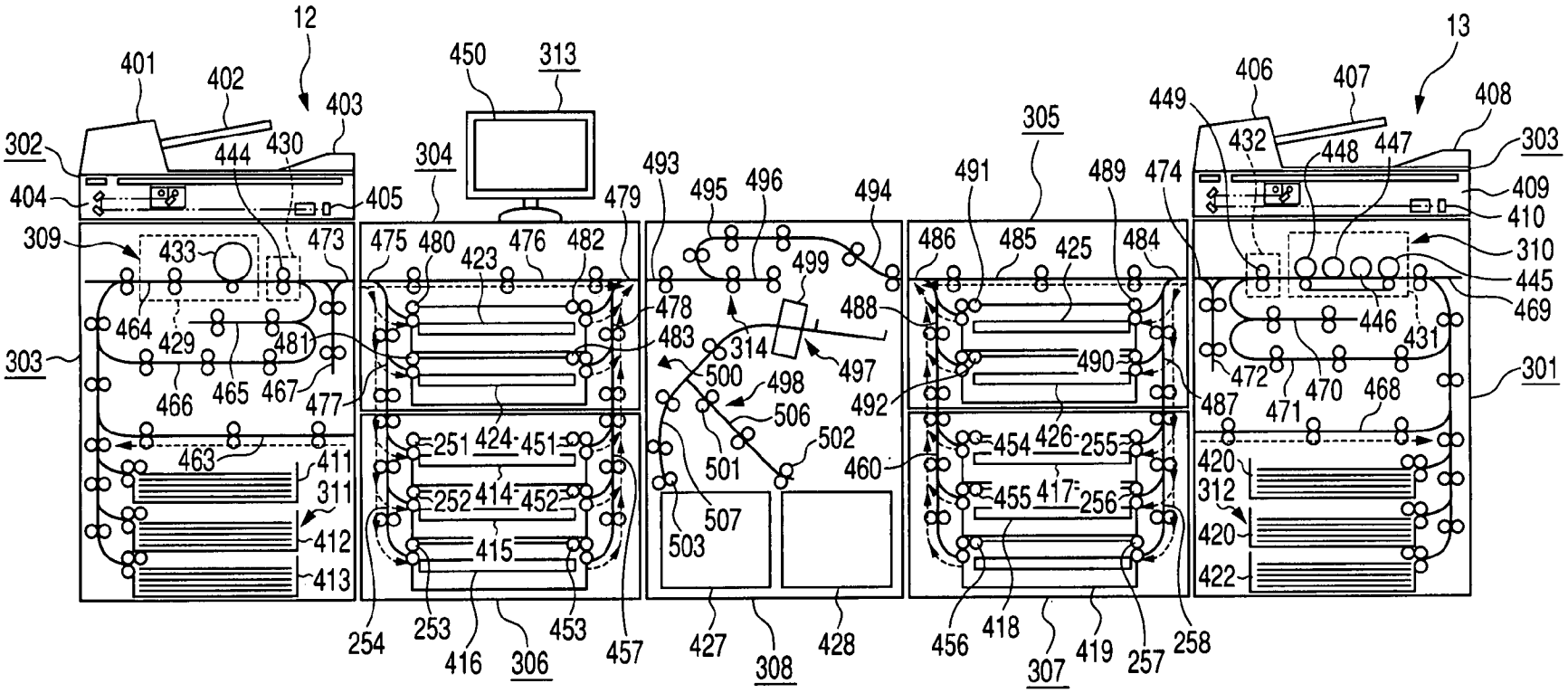
FIG. 1 is a longitudinal cross-sectional view showing the general construction of an image forming system according to a first embodiment of the present invention.

FIG. 1 is a longitudinal cross-sectional view showing the general construction of an image forming system according to a first embodiment of the present invention.

The image forming system, as shown in FIG. 1, is provided with a monochromatic image forming apparatus 12 and a color image forming apparatus 13. The monochromatic image forming apparatus 12 has a monochromatic printer 300 and an image reader 302 for monochrome disposed in the upper portion thereof. The color image forming apparatus 13 has a color printer 301 and an image reader 303 for color disposed in the upper portion thereof.

A first sheet storage portion 304 and a second sheet storage portion 306 are disposed in vertically superposed relationship with each other at a location adjacent to the monochromatic image forming apparatus 12. The first sheet storage portion 304 and the second sheet storage portion 306 can temporarily contain therein sheets on which images have been formed by the monochromatic printer 300 of the monochromatic image forming apparatus 12.

A third sheet storage portion 305 and a fourth sheet storage portion 307 are disposed in vertically superposed relationship with each other at a location adjacent to the color image forming apparatus 13. The third sheet storage portion 305 and the fourth sheet storage portion 307 can temporarily contain therein sheets on which images have been formed by the color printer 301 of the color image forming apparatus 13.

Between the first sheet storage portion 304, the second sheet storage portion 306 and the third sheet storage portion 305, the fourth sheet storage portion 307, there is disposed a finisher 308 as a sheet post-processing apparatus. The finisher 308 effects a post-process on the sheets on which the images have been formed by the monochromatic printer 300 of the monochromatic image forming apparatus 12 and the sheets on which the images have been formed by the color printer 301 of the color image forming apparatus 13, and discharges the sheets after the post-process.

A user interface (hereinafter referred to as the UI) 313 is provided in the upper portion of the first sheet storage portion 304.

Description will now be made of the construction of the image reader 302 for monochrome of the monochromatic image forming apparatus 12.

The image reader 302 for monochrome has a scanner portion 404 for reading the image of a document, and a document feeding portion 401 for supplying a set document to the scanner portion 404 while conveying the document. The document feeding portion 401 is mounted on the upper portion of the scanner portion 404 by a hinge (not shown) provided on the inner part side of the apparatus, and is designed to be openable and closable relative to the scanner portion 404.

The detailed construction and operation of the document feeding portion 401 are similar to those heretofore known and therefore need not be described in detail herein. The document feeding portion 401 conveys a bundle of documents (not shown) set on a document stacking tray 402 one by one onto contact glass, and discharges the documents read by the scanner portion 404 onto a document discharging tray 403. The construction of the image reader 303 for color of the color image forming apparatus 13 is similar to that of the image reader 302 for monochrome and therefore need not be described in detail.

The construction of the monochromatic printer 300 will now be described.

An image forming portion 309 is disposed in the central portion of the monochromatic printer 300. This image forming portion 309 is constructed as a printer engine by a well-known electrophotographic process, and contains electrophotographic process means 429, a fixing apparatus 430 and a laser writing-in apparatus (not shown) therein. In the electrophotographic process means 429 of the image forming portion 309, a laser beam is emitted on the basis of inputted image data (image data read by the image reader 302 for monochrome or image data inputted from an external device such as a host computer). The surface of a photosensitive drum 433 is exposed to and scanned by this laser beam. Thereby, an electrostatic latent image is formed on the photosensitive drum 433, and this electrostatic latent image is visualized as a toner image by a developing device (not shown). The toner image thus formed on the photosensitive drum 433 is transferred to a sheet conveyed from a sheet feeding portion 311, and the sheet to which the toner image has been transferred is conveyed to the fixing apparatus 430.

In the fixing apparatus 430, the toner image on the above-described sheet is heated and pressurized by fixing rollers 444, and is fixed on the sheet. The sheet passed between the fixing rollers 444 is conveyed to the first sheet storage portion 304 through a sheet discharging portion 473. At this time, the sheet is conveyed to the first sheet storage portion 304 with its image-formed side facing upwardly (face-up). On the other hand, the sheet is reversed by a sheet reversing path 467, whereby it is also possible for the sheet to be conveyed to the first sheet storage portion 304 with its image-formed side facing downwardly (face-down).

The above-mentioned sheet feeding portion 311 is provided in the lower portion of the monochromatic printer 300, and has vertically three stages of sheet stacking cassettes 411, 412 and 413 disposed so as to be capable of being drawn out relative to an apparatus main body. The sheet is fed from one of the sheet stacking cassettes 411, 412 and 413.

Also, the monochromatic printer 300 have a horizontally extending both-side reversing path 465 and a both-side path 466 in order to realize a so-called both-side mode for effecting image formation on the both sides of the sheet. The both-side reversing path 465 is connected to the both-side path 466, and the respective paths are disposed below the image forming portion 309. During the two-side mode, the sheet passed through the fixing apparatus 430 is once guided to the both-side reversing path 465, and thereafter is switched back and is conveyed to the both-side path 466. Thereby, the sheet is again conveyed to the image forming portion 309 with its image-formed side as its back side, and image formation on a second side thereof is effected. Then, the sheet on the second side of which image formation has been effected is conveyed toward the first sheet storage portion 304, as described above.

The construction of the color printer 301 will now be described.

An image forming portion 310 constituting a printer engine by the well-known electrophotographic process is disposed in the central portion of the color printer 301, and the image forming portion 310 contains electrophotographic process means 431, a fixing apparatus 432 and a laser writing-in apparatus (not shown) therein.

The electrophotographic process means 431 has four photosensitive drums 445, 446, 447 and 448. Electrostatic latent images are formed on the surfaces of the respective photosensitive drums 445, 446, 447 and 448 on the basis of inputted image data (image data read by the image reader 303 for color or image data inputted from an external device such as a host computer). The respective electrostatic latent images are visualized as toner images by color toners supplied from developing devices of corresponding colors. The toner images formed on the respective photosensitive drums 445, 446, 447 and 448 are successively superimposed and transferred as a color toner image onto a sheet fed from a sheet feeding portion 312, and the sheet onto which the color toner image has been transferred is conveyed to a fixing apparatus 432.

In the fixing apparatus 432, the color toner image on the sheet is heated and pressurized by fixing rollers 449, and the color toner image is fixed on the sheet. The sheet passed between the fixing rollers 449 is conveyed to the third sheet storage portion 305 through a sheet discharging portion 474. At this time, the sheet is conveyed to the third sheet storage portion 305 with its image-formed side facing upwardly (face-up). On the other hand, the sheet is reversed by a sheet reversing path 472, whereby it is also possible to convey the sheet to the third sheet storage portion 305 with its image-formed side facing downwardly (face-down).

The above-mentioned feeding portion 312 is provided in the lower portion of the color printer 301, and has vertically three stages of sheet stacking cassettes 420, 421 and 422 disposed so as to be capable of being drawn out relative to the apparatus main body.

Also, the color printer 301 has a both-side reversing path 470 and a both-side path 471 for realizing a two-side mode. Also, a horizontally disposed conveying path 468 is provided between the sheet feeding portion 312 and the both-side path 471.

The image forming operation and sheet conveying operation in the thus constructed color printer 301 are substantially similar to those in the monochromatic printer 300 and therefore need not be described here in detail.

The construction of the first sheet storage portion 304 will now be described.

In the upper portion of the first sheet storage portion 304, there is disposed a conveying path 475 for receiving the sheet on which the image has been formed by the monochromatic printer 300, and the downstream side of this conveying path 475 is connected to a vertically extending conveying path 477 and a horizontally extending conveying path 476. Also, two sheet trays 423 and 424 are provided downstream of the conveying path 477 and in the central portion of the first sheet storage portion 304, and the sheet trays 423 and 424 are designed to be capable of being drawn out to this side of the first sheet storage portion 304 relative to the apparatus main body. The sheet tray 423 is provided with rollers 480 for feeding the sheet conveyed on the conveying path 477 into the sheet tray 423, and sheet feeding rollers 482 for separating the sheets stacked on the sheet tray 423 one by one and feeding the sheets to a conveying path 478. Also, the sheet tray 424 is provided with rollers 481 for feeding the sheet conveyed on the conveying path 477 into the sheet tray 424, and sheet feeding rollers 483 for separating the sheets stacked on the sheet tray 424 one by one and feeding the sheets to the conveying path 478. The conveying path 478 comprises a vertically extending path, and the downstream side thereof joins the conveying path 476, and is connected to a conveying path 479 horizontally extending together with the conveying path 476.

The construction of the second sheet storage portion 306 will now be described.

The second sheet storage portion 306 has a vertically extending conveying path 254, and the upstream portion thereof is connected to the conveying path 477 of the first sheet storage portion 304. Also, three sheet trays 414, 415 and 416 are provided downstream of the conveying path 254 and in the central portion of the second sheet storage portion 306. The sheet trays 414, 415 and 416 are designed to be capable of being drawn out to this side of the second sheet storage portion 306 relative to the apparatus main body.

The sheet trays 414, 415 and 416 are provided with rollers 251, 252 and 253, respectively, for feeding the sheets conveyed on the conveying path 254 into the sheet trays 414, 415 and 416. They are also provided with sheet feeding rollers 451, 452 and 453 for feeding the sheets stacked on the sheet trays 414, 415 and 416 one by one to a conveying path 457. The conveying path 457 comprises a vertically upwardly extending path, and the downstream portion thereof is connected to the conveying path 478 of the first storage portion 304.

Description will now be made of the sheet conveying operation of the first sheet storage portion 304 and the second sheet storage portion 306 constructed as described above.

Figure 2:
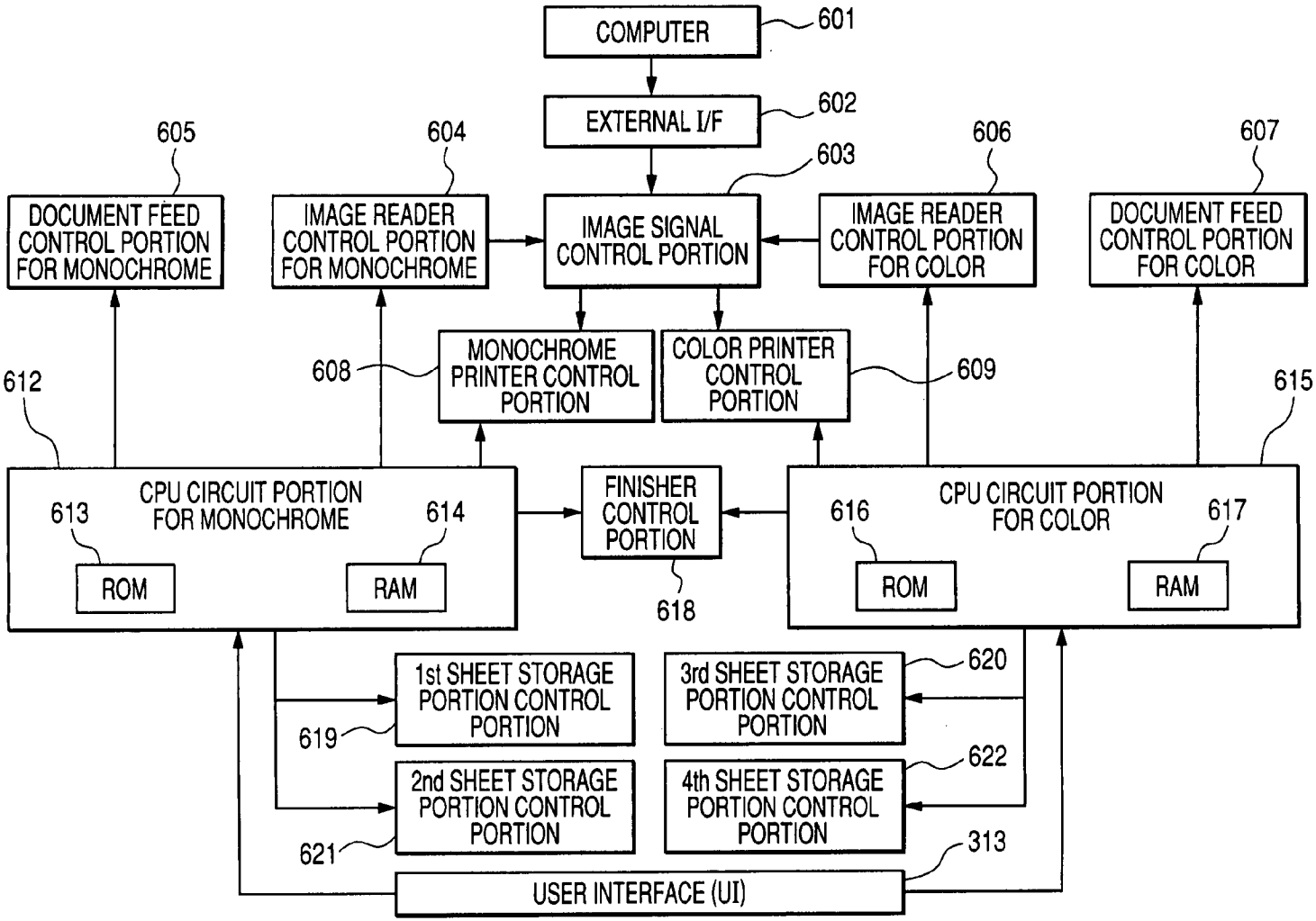
FIG. 2 is a block diagram showing the control construction of the image forming system of FIG. 1.

The sheet conveyed through the conveying path 473 is conveyed to the conveying path 477 in conformity with a command from a CPU circuit portion 612 for monochrome (FIG. 2). The sheet conveyed to the conveying path 477 is fed into one of the sheet trays 423 and 424 by rollers 480 and 481. Or the sheet conveyed to the conveying path 477 is fed into one of the sheet trays 414, 415 and 416 by the rollers 251, 252 and 253 via the conveying path 254.

The sheets discharged into the first sheet storage portion 304 are successively stacked on the vertically movable sheet trays 423 and 424. At this time, on the basis of the result of detection by an upper surface detecting sensor (not shown) for detecting the position of the sheet trays in the height direction thereof or the uppermost surface of the stacked sheets, the sheet trays 423 and 424 are held at a position whereat the position in the height direction thereof or the uppermost surface of the stacked sheets is always at a constant height. This sheet stacking construction is common to all of the sheet trays 414, 415, 416, 425, 426, 417, 418 and 419.

Description will now be made of the operation when the sheets are taken out of the first and second sheet storage portions 304 and 306. For example, the sheets stacked on the sheet tray 423 are separated and fed one by one in succession from the uppermost sheet by the sheet feeding rollers 482, and are fed out to the finisher 308 through the conveying path 478 and the conveying path 479. At this time, the sheet tray 423 is held at a position whereat the uppermost surface of the sheets is at a predetermined height on the basis of the output of the upper surface detecting sensor (not shown).

The third sheet storage portion 305 and the fourth sheet storage portion 307 have a construction substantially bilateral-symmetrical with the first sheet storage portion 304 and the second sheet storage portion 306. Also, the sheet conveying operation in the third sheet storage portion 305 and the fourth sheet storage portion 307 is substantially similar to that in the first sheet storage portion 304 and the second sheet storage portion 306. Consequently, detailed description of the third sheet storage portion 305 and the fourth sheet storage portion 307 will be omitted herein.

Here, the respective sheet storage portions 304, 306, 305 and 307 perform the operation of temporarily containing therein the sheets on which images have been formed by the corresponding image forming apparatuses, and can also stack thereon and feed sheets prepared in advance, e.g. covers or the like. Thus, the respective sheet storage portions 304, 306, 305 and 307 are also usable as inserters for inserting sheets such as covers into a bundle of sheets on which images have been formed.

The construction of the finisher 308 will now be described.

The finisher 308 has a conveying path 493 for conveying sheets on which monochromatic images have been formed, and a conveying path 494 for conveying sheets on which color images have been formed. The downstream portion of the conveying path 493 is connected to a conveying path 496. Also, the downstream side of the conveying path 494 is connected to a conveying path 495, and the conveying path 494 joins the conveying path 493 at a sheet joining portion 314 and is connected to the conveying path 496.

At a location downstream of and below the conveying path 496, there is disposed a sheet treating tray portion 497 including a treating tray (not shown) for effecting the alignment or the like of the sheets. Also, a staple unit 499 is disposed near the sheet treating tray portion 497, and the staple unit 499 carries out a stapling process on the sheets placed on the treating tray.

The downstream side of the sheet treating tray portion 497 is connected to a conveying path 507 and a conveying path 506, and discharging rollers 503 are provided downstream of the conveying path 507. At the branch-off position of the conveying path 507 and the conveying path 506, there is provided a sheet folding portion for carrying out the process of folding the sheets, and the sheet folding portion 496 has a thrusting-out member 500, folding rollers 501 and discharging rollers 502.

Two stacking trays 427 and 428 are disposed in the lower portion of the finisher 308, and sheets post-treated by the sheet treating tray portion 497 and the sheet folding portion 498 are discharged to and stacked on the respective stacking trays 427 and 428.

The construction of the UI 313 will now be described.

The UI 313 is comprised of a joint operator control apparatus/CRT display having a dialog type touch panel 450, a keyboard (not shown) and a mouse (not shown). The UI 313 constitutes an interface with an operator and the monochromatic image forming apparatus 300, the color image forming apparatus 301, the first and second sheet storage portions 304 and 306, the third and fourth sheet storage portions 305 and 307 and the finisher 308. Also, the UI 313 enables the operator to program a print job and other commands in order to obtain system operating information, a command, programing information, diagnosis information, etc. If in the UI 313, an item displayed on the touch panel 450 is touched by a finger or an item selected by a carsol is designated by the use of the mouse, an operation corresponding to the item displayed on the touch panel 450 will be started.

The control construction of the image forming system according to the present embodiment will now be described with reference to FIG. 2. FIG. 2 is a block diagram showing the control construction of the image forming system of FIG. 1.

A control portion for controlling the image forming system has a CPU circuit portion 612 for monochrome having a ROM 613, a RAM 614, etc., and a CPU circuit portion 615 for color having a ROM 616, a RAM 617, etc. Also, this control portion has a document feed control portion 605 for monochrome which effect the control of the document feeding portion 401 of the image reader 302 for monochrome, and a document feed control portion 607 for color which effects the control of the document feeding portion 406 of the image reader 303 for color. Also, this control portion has an image reader control portion 604 for monochrome which effects the control of the scanner portion 404 of the image reader 302 for monochrome, and an image reader control portion 606 for color which effects the control of the scanner portion 409 of the image reader 406 for color. Also, this control portion has an image signal control portion 603 which effects such control as effecting various kinds of image processing on image signals produced by the image reader 302 for monochrome and the image reader 303 for color. Also, this control portion has a monochromatic printer control portion 608 which effects the control of the monochromatic printer 300, and a color printer control portion 609 which effects the control of the color printer 301. Also, this control portion has a first sheet storage portion control portion 619 which effects the control of the first sheet storage portion 304, and a second sheet storage portion control portion 621 which effects the control of the second sheet storage portion 306. Also, this control portion has a third sheet storage portion control portion 620 which effects the control of the third sheet storage portion 305, and a fourth sheet storage portion control portion 622 which effects the control of the fourth sheet storage portion 307. Further, this control portion has a finisher control portion 618 which effects the control of the finisher 308.

Each of the CPU circuit portion 612 for monochrome and the CPU circuit portion 615 for color is connected to the UI 313, and outputs a control command to a corresponding control block on the basis of an input from the UI 313. The CPU circuit portion 612 for monochrome is for effecting chiefly the control of the monochromatic image forming apparatus 300 and the first and second sheet storage portions 304 and 306. The CPU circuit portion 612 for monochrome outputs a control command to the external I/F 602 on the basis of a program stored in the ROM 613 and an input from the UI 313. The external I/F 602 is connected to the document feed control portion 605 for monochrome, the image reader control portion 604 for monochrome, the image signal control portion 603, the monochromatic printer control portion 608, the first sheet storage portion control portion 619 and the second sheet storage portion control portion 621. Also, the external I/F 602 is connected to the finisher control portion 618 and the image signal control portion 603. The RAM 614 of the CPU circuit portion 612 for monochrome is used as a memory for providing an area temporarily holding control data therein, and a working area for a calculation accompanying the control.

The CPU circuit portion 615 for color is for effecting chiefly the control of the color image forming apparatus 301 and the third and fourth sheet storage portions 305 and 307. The CPU circuit portion 615 for color outputs a control command to the external I/F 602 on the basis of a program stored in the ROM 616 and an input from the UI 313. The external I/F 602 is connected to the document feed control portion 607 for color, the image reader control portion 606 for color, the image signal control portion 603, the color printer control portion 609, the third sheet storage portion control portion 620 and the fourth sheet storage portion control portion 622. Also, the external I/F 602 is connected to the finisher control portion 618 and the image signal control portion 603, as previously described. The RAM 617 of the CPU circuit portion 615 for color, like the RAM 614 of the CPU circuit portion 612 for monochrome, is used as a memory for providing an area temporarily holding control data therein, and a working area for a calculation accompanying the control.

In the monochromatic image forming apparatus 12, image data read by the image sensor 405 of the scanner portion 404 is outputted from the image reader control portion 604 for monochrome to the image signal control portion 603. In the image signal control portion 603, predetermined image processing is carried out on the above-mentioned image data, and the image data after this image processing is outputted to the monochromatic printer control portion 608.

In the color image forming apparatus 13, image data read by the image sensor 410 of the scanner portion 303 is outputted from the image reader control portion 606 for color to the image signal control portion 603. The image data is then outputted to the color printer control portion 609 after predetermined processing has been carried out on the image data by the image signal control portion 603.

Also, in the image forming system according to the present embodiment, a computer 601 as a host terminal machine is connected to the image signal control portion 603 through the external I/F 602, and the present image forming system is usable as a printer. In this case, the image reader control portion 604 for monochrome and the image reader control portion 606 for color are not used, and print data outputted from the computer 601 is outputted to the image signal control portion 603 through the external I/F 601. The print data is then outputted to the monochromatic printer control portion 608 or the color printer control portion 609 after predetermined processing has been carried out on the image data by the image signal control portion 603.

Figure 3:
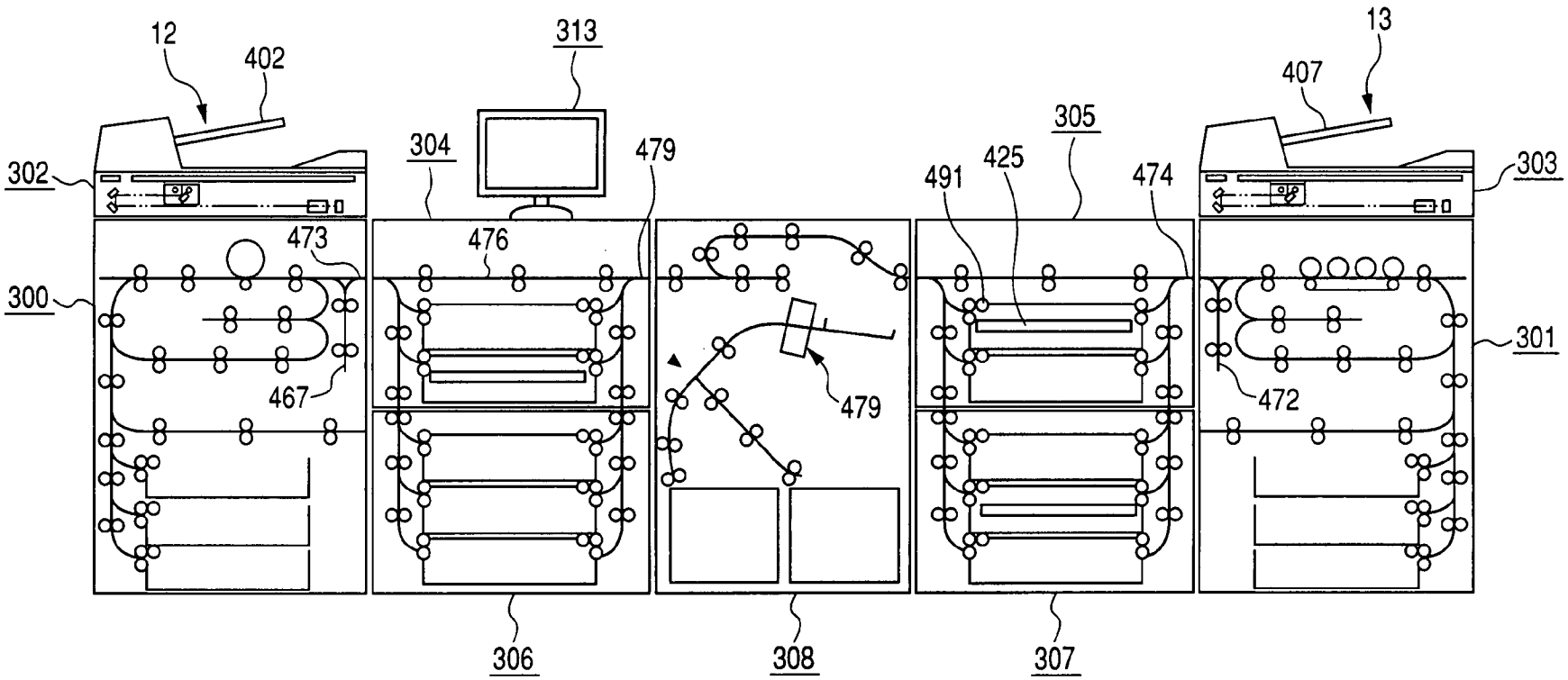
FIG. 3 is a typical view showing the operation of the image forming system of FIG. 1.

The operation of the image forming system according to the present embodiment will now be described with reference to FIG. 3. FIG. 3 is a typical view showing the operation in the case of a copy job in which sheets on which images have been formed by one image forming apparatus and which are temporarily contained in the sheet storage portions and sheets on which images have been formed by the other image forming apparatus and which are not temporarily contained in the sheet storage portions are stacked in the order of pages. The sheets which are not temporarily contained in the sheet storage portions are sheets which bypass the sheet storage portions.

It is to be understood here that a copy job of outputting a predetermined number of copies each comprising twenty sheets is effected, for example, on monochromatic documents and color documents mixedly stacked. Also, it is to be understood that in this copy job, the first, tenth and twentieth sheets in each one copy on which color images have been formed are inserted.

In the case of this copy job, as shown in FIG. 3, monochromatic documents are set on the document stacking tray 402 of the image reader 302 for monochrome, and color documents are set on the document stacking tray 407 of the image reader 303 for color. Then, the page information of the chromatic documents and the color documents is inputted by the UI 313, and the designation of into what page of the sheets on which chromatic images have been formed the sheets on which color images have been formed should be inserted is effected. It is to be understood here that as described above, setting is effected so that sheets on which color images have been formed may be inserted onto the first, tenth and twentieth sheets in each one copy.

When the necessary setting is completed in this manner, the monochromatic image forming apparatus 12 and the color image forming apparatus 13 start to operate on the basis of set information from the UI 313. In the respective image forming apparatuses 12 and 13, the documents set thereon are first read by the image reader 302 for monochrome and the image reader 303 for color, respectively. The image data thereof are then sent to and held in the monochromatic printer control portion 608 and the color printer control portion 609 through the image signal control portion 603.

Then, the monochromatic printer 300 of the monochromatic image forming apparatus 12 reads out the image data of the monochromatic documents in succession from the top page direction, and each time image data is read out, the monochromatic printer 300 forms a monochromatic image on a sheet on the basis of that image data. This sheet on which the monochromatic image has been formed is conveyed a sheet discharging port 479 to the finisher 308 via a sheet discharging port 473 and the horizontal conveying path 476 of the first sheet storage portion 304 after the reversal of the front side and back side of the sheet has been effected by the sheet reversing path 467. The sheet on which the monochromatic image has been formed and which has been conveyed to the finisher 308 is stacked on the sheet treating tray portion 497 with its image-formed side facing downwardly (in its face-down state).

In contrast, in the color printer 301, the image data of the color documents are successively read out from the last page direction, and each time image data is read out, a color image is formed on a sheet on the basis of that image data. This sheet on which the color image has been formed is not reversed by the sheet reversing portion 472, but is conveyed from a sheet discharging port 474 to the sheet tray 425 of the third sheet storage portion 305 with its image-formed side facing upwardly (face-up). Then, a predetermined number of copies are repetitively stacked on the sheet tray 425 in the order of the twentieth sheet, the tenth sheet, the first sheet, and the twentieth sheet, the tenth sheet, the first sheet from below. When the timing at which the uppermost sheet of the bundle of sheets thus stacked on the sheet tray 425 is inserted comes, the uppermost sheet is separated and conveyed by the sheet feeding rollers 491. Thereafter, this sheet is stacked on the sheet treating tray portion 497 in its face-down state.

The sheet of the corresponding page on which a color image has been formed is inserted onto the sheets on which the chromatic images have been formed by the monochromatic printer 300 through such a series of operations. As a result, there is obtained a copy output in which the sheets on which the chromatic images have been formed and the sheets on which the color images have been formed and which are stacked in the order of pages are mixedly present.

As described above, the sheets on which the monochromatic images have been formed by the monochromatic printer 300 are not stored in the sheet storage portions 304 and 306, but are conveyed to the finisher 308. On the other hand, the sheets on which the color images have been formed by the color printer 301 are temporarily stored in the third sheet storage portion 305, and thereafter are conveyed to the finisher 308. Then, in the finisher 308, the sheets on which the monochromatic images have been formed and the sheets on which the color images have been formed are stacked in the order of pages. In the case of such a job, in the color printer 301, conversely to the monochromatic printer 300, the image data are read out from the last page direction and image formation is effected, and the sheets on which the color images have been formed are temporarily stored in the third sheet storage portion 305. At this time, the sheets are stacked on the sheet tray 425 of the third sheet storage portion 305 in succession from the last page direction, and sheets are fed onto the sheets on the sheet tray 425 in succession from the uppermost sheet.

In a case where with regard to the job as described above, the sheets are stacked on the sheet storage portion in succession from the top page direction, and particularly in a case where the sheets are stored in a great deal, the sheets stacked on the sheet storage portion are separated and conveyed in succession from the lowermost sheet. At this time, however, faulty separation and conveyance may occur or the images may suffer draw-out injuries or frictional contact prints. In contrast, if as in the present embodiment, design is made such that image data are read out from the last page direction and image formation is effected, whereby the sheets are stacked on the sheet storage portion from the last page direction, it becomes possible to feed the sheets in succession from the uppermost sheet. Thereby, it becomes possible to avoid such problems as the occurrence of unfaulty separation and conveyance, and the images suffering draw-out injuries or frictional contact prints, and even for a job in which a great deal of sheets need be temporarily stored in the sheet storage portion, it becomes possible to feed the sheets stably from the sheet storage portion.

Also, in the above-described copy job, description has been made of a case where the monochromatic image forming apparatus 12 and the color image forming apparatus perform operations in parallel with each other, but the present invention is not restricted to such an embodiment. For example, design may be made such that before the start of the operation of the monochromatic image forming apparatus 12, color image formation is effected on a sheet inserted by the color printer 301, and the sheet on which a color image has been formed is temporarily stored in the third sheet storage portion 305. Likewise, sheets are stacked on the sheet tray 425 of the third sheet storage portion 305 in succession from the last page direction, and the third sheet storage portion 305 assumes a state waiting for the feeding of the sheets stored therein. Then, the operation of the monochromatic image forming apparatus 12 is started, whereupon a sheet is fed from the sheet tray 425 of the third sheet storage portion 305 in timed relationship with the conveyance of the sheet on which a monochromatic image has been formed by the monochromatic printer 301. The sheet fed at this time is the uppermost sheet.

Also, a series of operations for the above-described job is the operations in the case of a copy job, but the present invention is not restricted to such an embodiment. For example, in a case where the present image forming system is used as a printer, the monochromatic printer 300 and the color printer 301 are operated on the basis of print data outputted from the computer 601 through the external I/F 602. Here, as in the above-described job, the sheets on which monochromatic images have been formed by the monochromatic printer 300 are not stored in the first and second sheet storing portions 304 and 306, but are conveyed to the finisher 308. On the other hand, the sheets on which color images have been formed by the color printer 301 are temporarily stored in the third sheet storage portion 305, and thereafter are conveyed to the finisher 308. Then, in the finisher 308, the sheets on which the monochromatic images have been formed and the sheets on which the color images have been formed are stacked in the order of pages. Again in the case of such a print job, in the color printer 301, conversely to the monochromatic printer 300, image data are read out from the last page direction and image formation is effected. Then, the sheets on which the color images have been formed are temporarily stored in the third sheet storage portion 305 in succession from the last page direction.

Figure 4:
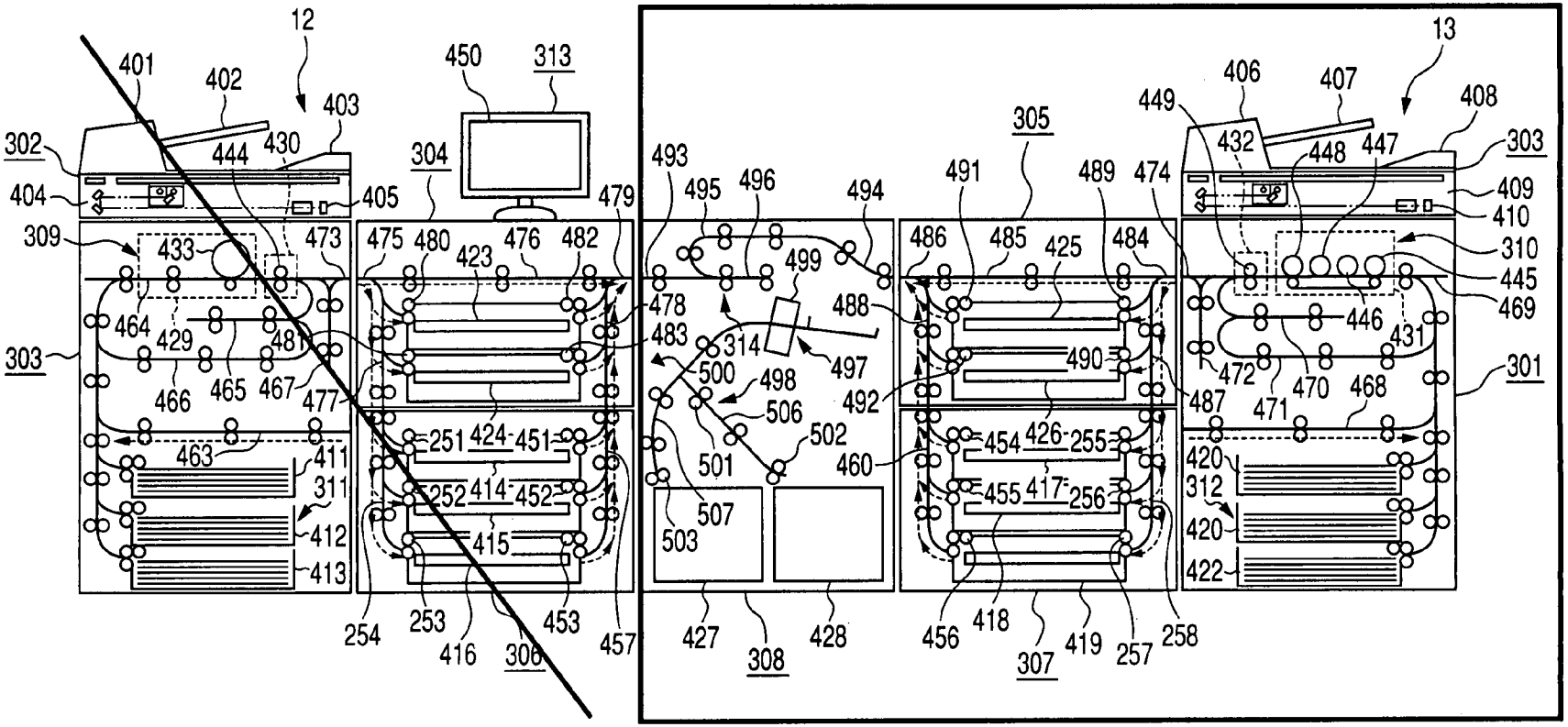
FIG. 4 shows an example of the alternative construction of the image forming system according to the first embodiment of the present invention.

Also, in the image forming system according to the present embodiment, as shown in FIG. 4, it is possible to execute the above-described copy job by the use of the color image forming apparatus 13, the third and fourth sheet storage portions 305 and 307, and the finisher 308.

In this case, in the order of the twentieth sheet, the tenth sheet and the first sheet, image data corresponding thereto are first read out by the color printer 301, and on the basis of the image data read out, color image formation is repetitively effected for a predetermined number of copies. Then, the twentieth sheet, the tenth sheet, the first sheet, the twentieth sheet, the tenth sheet, the first sheet, and so on in a predetermined number of copies on which the color images have been formed are repetitively stacked on the sheet tray 425 of the third sheet storage portion 305.

When the temporary storage of the sheets in the predetermined number of copies on which the color images have been formed into the third sheet storage portion 305 is completed, the color printer 301 reads out image data to be formed as monochromatic images in succession from the top page direction. Each time image data is read out, the color printer 301 forms a monochromatic image on a sheet on the basis of that image data by the use of a photosensitive drum 445 for forming a black image. This sheet on which the monochromatic image has been formed is conveyed from the sheet discharging port 486 to the finisher 308 via the sheet discharging port 474 and the horizontal conveying path 485 of the third sheet storage portion 305 after the reversal of the front side and back side of the sheet has been effected by the sheet reversing path 472. The sheet on which the monochromatic image has been formed and which has been conveyed to the finisher 308 is stacked on the sheet treating tray portion 497 with its image-formed side facing downwardly (in its face-down state).

When during the above-described monochromatic image formation, the timing at which the uppermost sheet of a bundle of sheets stacked on the sheet tray 425 is inserted comes, the uppermost sheet is separated and conveyed to the sheet treating tray portion 497 by the sheet feeding rollers 491. Thereafter, this sheet is stacked on the sheet treating tray portion 497 in its face-down state.

That is, even if in the construction of the image forming system shown in FIG. 1, use is made of the color image forming apparatus 13, the third and fourth sheet storage portions 305 and 307, and the finisher 308, it is possible to obtain an effect similar to that described above.

Figure 5:
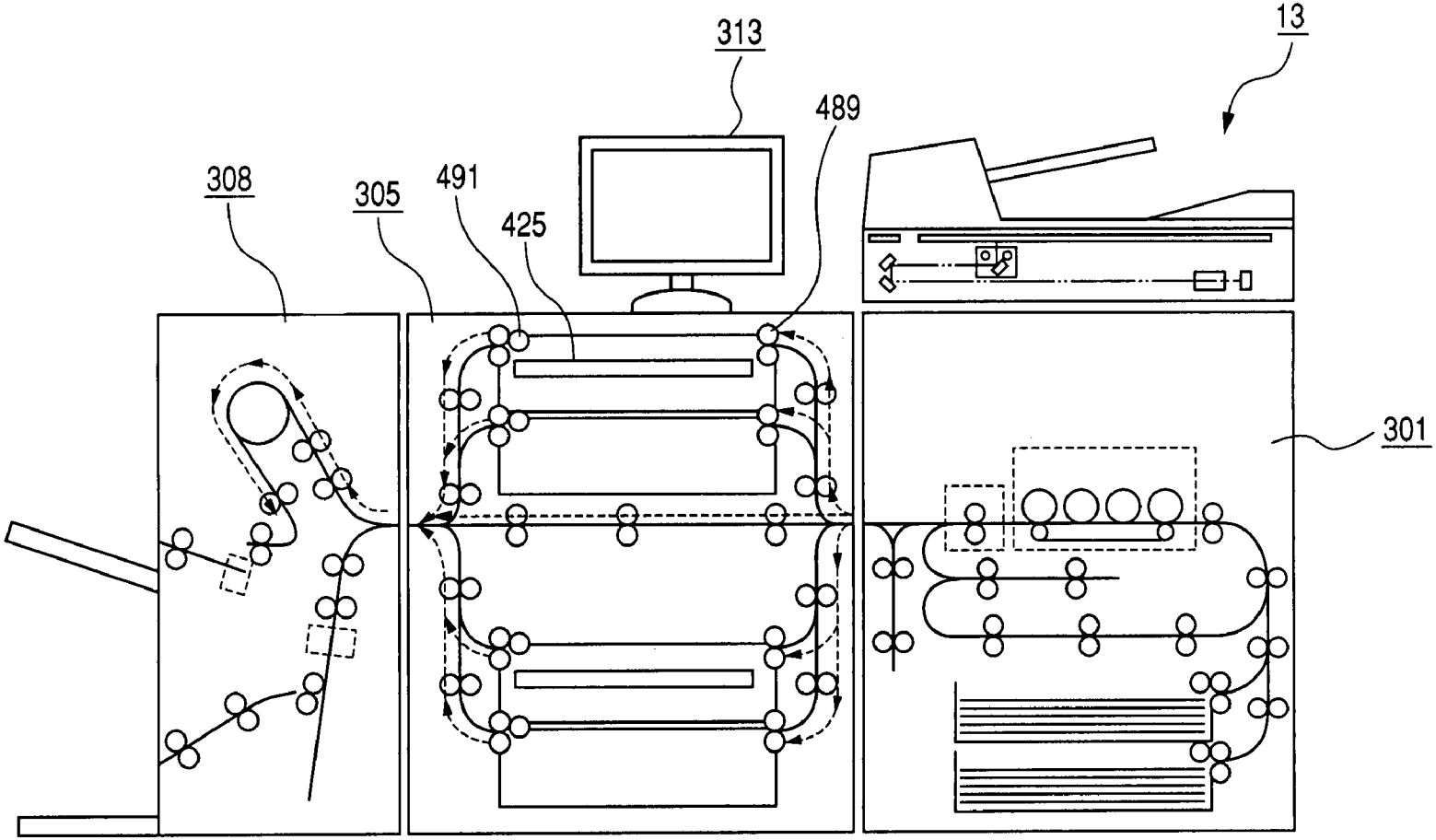
FIG. 5 shows another example of the alternative construction of the image forming system according to the first embodiment of the present invention.

Also, in a case where as shown in FIG. 5, an image forming system comprising a color image forming apparatus 13, at least one of sheet storage portions 305 and 307, and a finisher 308 is constructed, it is possible to obtain a similar effect.

Second Embodiment

Figure 6:
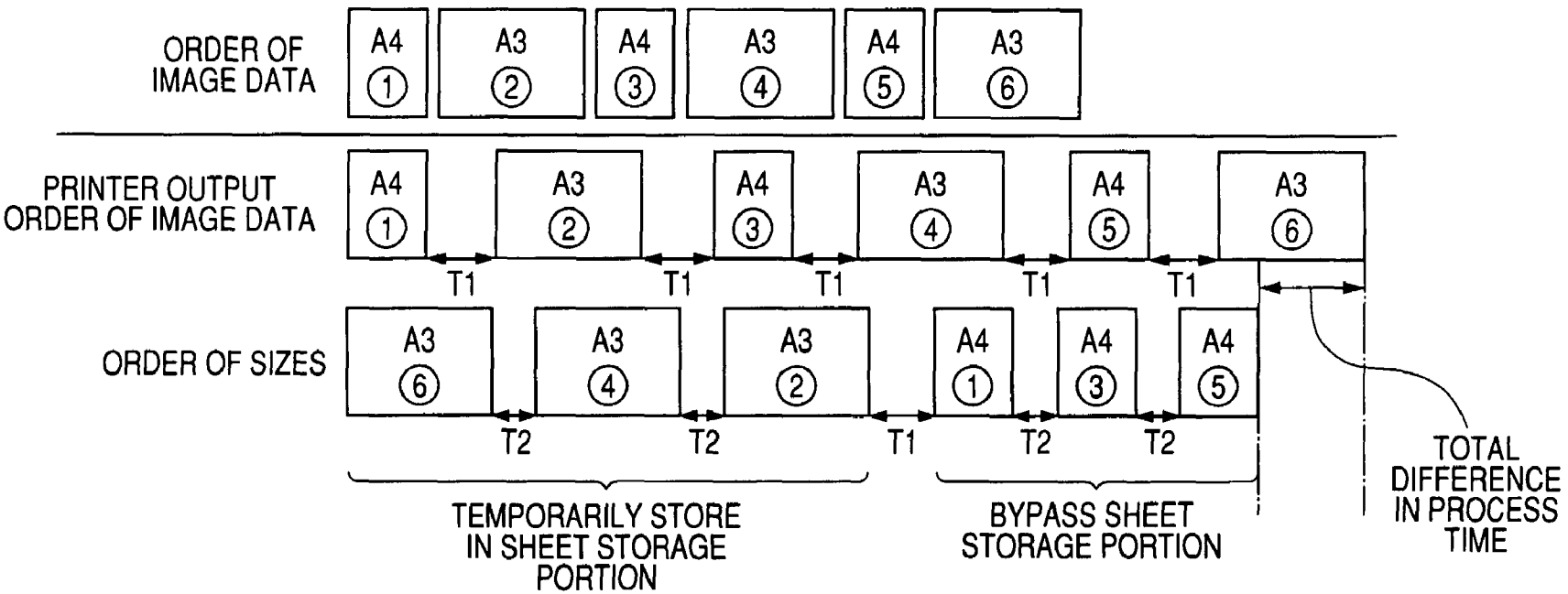
FIG. 6 typically shows sheet intervals in a job in an image forming system according to a second embodiment of the present invention.

A second embodiment of the present invention will now be described with reference to FIG. 6. FIG. 6 typically shows the sheet intervals in a job in an image forming system according to the second embodiment of the present invention. The present embodiment has the same construction as the above-described first embodiment, and the construction need not be described. Also, in the description of the present embodiment, use is made of the same reference characters as those in the first embodiment.

In the present embodiment, description will be made of the case of a job in which a group of documents in which documents of different sizes are mixedly present are copy-outputted by the use of the color image forming apparatus 13, the third and fourth sheet storage portions 305 and 307, and the finisher 308 (see FIG. 4).

FIG. 6 shows a case where in such a copy job, image formation is effected in the order of pages. The sheet interval T1 between sheets of different sizes, as compared with the sheet interval when sheets of the same size are conveyed, need be secured greatly in order to curtail the number of sheets held in the path of the image forming apparatus in conformity with a change in the stages of the sheet supplying cassettes and the execution of a both-side mode or the like. Therefore, if the number of copies is increased, the number of sections having the sheet interval T1 becomes great and the productivity of image formation is greatly lowered. Here, for example, a value corresponding to a predetermined inter-sheet time+a cassette changeover time is set as the sheet interval T1.

So, such a construction as will not lower the productivity even during the mixed presence of documents of different sizes is necessary. When for example, the copy job of such a group of six documents of which the second, fourth and sixth documents are documents of A3 size and the remainder are documents of A4 size is to be executed, the color image forming apparatus 301 first executes image formation for the documents smaller in number, or documents of larger sizes if the same in number. Here, the documents for which image formation is effected at first are the images of the documents of A3 size, and the image data of the sixth, fourth and second documents from the last page direction are successively read out, and images are formed on sheets. This image formation is repetitively effected by an amount corresponding to a predetermined number of copies. The sheets on which images have been formed are conveyed at an interval equal to a sheet interval T2, and are temporarily stored, for example, in the sheet tray 425 of the third sheet storage portion 305. A predetermined number of copies such as the sixth, fourth, second, sixth, fourth and second sheets are repetitively stacked on the sheet tray 425 of the third sheet storage portion 305.

Thereafter, the first, third and fifth documents of A4 size, i.e., image data from the top page direction, are successively read out and images are formed on sheets. This image formation is repetitively effected by an amount corresponding to a predetermined number of copies. The sheets on which the images have been formed are conveyed to the sheet treating tray portion 497 at the interval equal to the sheet interval T2, and are stacked on the sheet treating tray portion 497 with their image-formed sides facing downwardly (in their face-down state). Here, the sheet interval T2 is a value corresponding to the above-mentioned predetermined time, and the relation that T2<T1 is materialized.

When during the formation of the image of the document of A size, the timing at which the uppermost sheet of the bundle of sheets stacked on the sheet tray 425 is inserted comes, the uppermost sheet is separated and conveyed to the sheet treating tray portion 497 by the sheet feeding rollers 491. Thereafter, this sheet is stacked on the sheet treating tray portion 497 in its face-down state. Thereby, there is obtained a copy output in which the sheet for a corresponding page on which the image has been formed and sheets of different sizes having images formed thereon and stacked in the order of pages are mixedly present.

In the case of the copy job for such a group of documents in which documents of different sizes are mixedly present, for documents of a predetermined size, image data are read out from the last page direction to thereby effect image formation, and sheets on which images have been formed are temporarily stored in the sheet storage portion. Thereby, it becomes possible to feed the sheets in the sheet storage portion in succession from the uppermost sheet, and such problems as the occurrence of faulty separation and conveyance, and the images suffering draw-out injuries or frictional contact prints can be avoided.

Also, even for a job in which a great deal of sheets need be temporarily stored in the sheet storage portion, it becomes possible to feed the sheets stably from the sheet storage portion.

The copy job for a group of documents in which documents of different sizes are mixedly present can be likewise executed also in the image forming system shown in FIG. 5, and a similar effect can be obtained.

Third Embodiment

A third embodiment of the present invention will now be described. This embodiment has the same construction as that of the above-described first embodiment, and the construction need not be described. Also, in the description of the present embodiment, use is made of the same reference characters as those in the first embodiment.

In the first or second embodiment, description has been made of a case where some of the sheets in the same copy job on which images have been formed are temporarily stored in the sheet storage portion and the remainder are not stored in the sheet storage portion. On the other hand, in the present embodiment, description will be made of a case where when a copy job is executed and yet, other copy job is executed in parallel with that copy job, the sheet storage portion is used for one copy job and the sheet storage portion is not used for the other copy job.

Description will be made here of a case where, for example, a copy job using the monochromatic image forming apparatus 12 and a copy job using the color image forming apparatus 13 are executed in parallel with each other.

As regards the copy job using the monochromatic image forming apparatus 12, a monochromatic document is set on the document stacking tray 402 of the image reader 302 for monochrome, and the number of pages of the monochromatic document, the number of output copies, the substance of the sheet treatment by the finisher 308, etc. are set by the UI 313. Also, as regards the copy job using the color image forming apparatus 13, a color document is set on the document stacking tray 407 of the image reader 303 for color, and the number of pages of the color document, the number of output copies, the substance of the sheet treatment by the finisher 308, etc. are set by the UI 313.

When the setting for the respective copy job is completed, the respective copy jobs are started. It is to be understood here that the respective jobs are started in parallel with each other. Also, it is to be understood that the number of output sheets of the copy job using the color image forming apparatus 13 is very small relative to the total number of output sheets of the copy job using the monochromatic image forming apparatus 12. In this case, in the copy job using the color image forming apparatus 13, the image forming operation of the color printer 301 is terminated earlier than the image forming operation of the monochromatic printer 300. Accordingly, it is to be understood that the third and fourth sheet storage portions 305 and 307 are used for the copy job using the color image forming apparatus 13, and the first and second sheet storage portions 304 and 306 are not used for the copy job using the monochromatic image forming apparatus 12.

In the monochromatic image reading apparatus 12, the set document is first read by the image reader 302 for monochrome, and the image data thereof is sent to and held in the monochromatic printer control portion 608 through the image signal control portion 603.

Then, the monochromatic printer 300 of the monochromatic image forming apparatus 12 reads out the read image data in succession from the top page direction, and each time the image data is read out, the monochromatic printer 300 forms a monochromatic image on a sheet on the basis of that image data. This sheet on which the monochromatic image has been formed is conveyed from the sheet discharging port 479 to the finisher 308 via the sheet discharging port 473 and the horizontal conveying path 476 of the first sheet storage portion 304 after the front side and back side of the sheet have been reversed by the sheet reversing path 467. The sheet on which the monochromatic image has been formed and which has been conveyed to the finisher 308 is stacked on the sheet treating tray portion 497 with its image-formed side facing downwardly (in its face-down state), and is subjected to the set sheet post-process, and thereafter is discharged to the stacking trays 427 and 428.

In the color image forming apparatus 13, the set document is first read by the image reader 303 for color, and the image data thereof is sent to and held in the color printer control portion 609 through the image signal control portion 603.

Then, the color printer 301 of the color image forming apparatus 13, each time image data is read out in succession from the last page direction, forms a color image on a sheet on the basis of that image data. This sheet on which the color image has been formed is not reversed by the sheet reversing portion 472, but is conveyed from the sheet discharging port 474 to the sheet tray 425 of the third sheet storage portion 305 with its image-formed side facing upwardly (face-up). Then, sheets are repetitively stacked on the sheet tray 425 by an amount corresponding to a predetermined number of copies in succession from the last page direction.

If the copy job by the monochromatic image forming apparatus 12 is not yet terminated at a point of time whereat all of the predetermined number of sheets have been stored in the sheet tray 425, the third sheet storage portion 305 assumes a state waiting for the feeding of the sheets. When the copy job by the monochromatic image forming apparatus 12 is then terminated, the sheets stacked on the sheet tray 425 are separated one by one in succession from the uppermost sheet by the sheet feeding rollers 491 and are conveyed to the finisher 308. The sheets on which the color images have been formed and which have been conveyed to the finisher 308 are stacked on the sheet treating tray portion 497 with their image-formed sides facing downwardly (in their face-down state), and are subjected to the set sheet post-process, and thereafter are discharged to the stacking tray 427 and 428.

In a case where as described above, a plurality of copy jobs are executed in parallel with each other, in one copy job, the image data are read out from the last page direction to thereby effect image formation, and the sheets on which images have been formed are temporarily stored in the sheet storage portion. Thereby, it becomes possible to feed the sheets in the sheet storage portion in succession from the uppermost sheet, and it is possible to avoid such problems as the occurrence of faulty separation and conveyance, and the images suffering draw-out injuries or frictional contact prints. Also, even for a job in which a great deal of sheets need be temporarily stored in the sheet storage portion, it becomes possible to feed the sheets stably from the sheet storage portion.

Also, if after the termination of the image forming operation of the color printer 301, there is a job succeeding to it, this job can be started. If the finisher 308 is operating at a point of time whereat this next job is started, in the next job, image data are read out from the last page direction and image formation is effected, and the sheets on which images have been formed are temporarily stored in the sheet storage portion.

As described above, according to the embodiments of the present invention, when a job including the process of temporarily storing the sheets on which images have been formed is executed, the temporarily stored sheets can be stably fed without being given injuries.

This application claims priority from Japanese Patent Application Nos. 2004-269972 filed on. Sep. 16, 2004 and 2005-175145 filed on Jun. 15, 2005, which are hereby incorporated by reference herein.

What is claimed is:

1. An image forming system comprising:

at least one image forming apparatus for forming images on sheets on the basis of image data, said at least one image forming apparatus including a control portion;

at least one temporary containing apparatus disposed downstream of said at least one image forming apparatus for temporarily containing therein the sheets on which the images have been formed;

a separating and conveying apparatus for separating and conveying the sheets contained in said temporary containing apparatus one by one; and a sheet post-processing apparatus for (i) conveying the sheets conveyed by said separating and conveying apparatus and the sheets on which the images have been formed by said at least one image forming apparatus and which have bypassed said temporary containing apparatus in an arbitrary order, and (ii) effecting a set post-process on said conveyed sheets;

wherein the control portion of said at least one image forming apparatus makes the order of outputting of the image data to the sheets contained in said temporary containing apparatus and the order of outputting of the image data to the sheets which bypass said temporary containing apparatus reverse to each other.

2. An image forming system according to claim 1, wherein the order of outputting of the image data to the sheets contained in said temporary containing apparatus is the order from the last page direction, and the order of outputting of the image data to the sheets which bypass said temporary containing apparatus is the order from the top page direction.

3. An image forming system according to claim 1, wherein the sheets contained in said temporary containing apparatus and the sheets which bypass said temporary containing apparatus are ones in different jobs.

4. An image forming system according to claim 1, wherein the sheets contained in said temporary containing apparatus and the sheets which bypass said temporary containing apparatus are sheets of different sizes.

5. An image forming system according to claim 1, wherein the sheets contained in said temporary containing apparatus and the sheets which bypass said temporary containing apparatus are ones in the same job.

6. An image forming system according to claim 1, wherein said temporary containing apparatus comprises:

a containing tray for containing the sheets therein, said containing tray being vertically movable so that the upper surface of the uppermost sheet contained in said containing tray may be at a predetermined height position.

7. An image forming system according to claim 1, wherein said separating and conveying apparatus has an upper separating and conveying device for separating and conveying the sheets contained in said temporary containing apparatus in succession from the uppermost sheet.

8. An image forming system according to claim 1, further comprising a conveyance control device for controlling whether the sheets on which the images have been formed by said at least one image forming apparatus should be conveyed to said temporary containing apparatus or should be conveyed while bypassing said temporary containing apparatus.

9. An image forming system according to claim 8, wherein said conveyance control device controls so that the sheets on which color images have been formed may be contained in said temporary containing apparatus, and the sheets on which monochromatic images have been formed may be conveyed while bypassing said temporary containing apparatus.

10. An image forming system according to claim 8, wherein said conveyance control device controls so that the sheets of sizes of which the number is small may be contained in said temporary containing apparatus, and the sheets of sizes of which the number is great may be conveyed while bypassing said temporary containing apparatus.

11. An image forming method for an image forming system provided with at least one image forming apparatus for forming images on sheets on the basis of image data, at least one temporary containing apparatus disposed downstream of said at least one image forming apparatus for temporarily containing therein the sheets on which the images have been formed, a separating and conveying apparatus for separating and conveying the sheets contained in said temporary containing apparatus one by one, and a sheet post-processing apparatus for conveying the sheets conveyed by said separating and conveying apparatus and the sheets on which the images have been formed by said at least one image forming apparatus and which bypass said temporary containing apparatus in an arbitrary order, and effecting a set post-process on said conveyed sheets, the method comprising:

reversing the order of outputting of the image data to the sheets contained in said temporary containing apparatus from the order of outputting of the image data to the sheets which bypass said temporary containing apparatus.

12. An image forming method according to claim 11, wherein the order of outputting of the image data to the sheets contained in said temporary containing apparatus is the order from the last page direction, and the order of outputting of the image data to the sheets which bypass said temporary containing apparatus is the order from the top page direction.

* * * * *